United States Patent [19]

Bohnenkamp

[11] Patent Number: 4,967,582

[45] Date of Patent: Nov. 6, 1990

[54] BENDING AND BALANCING MECHANISM FOR THE AXIALLY SHIFTABLE ROLLS OF A ROLL STAND

[75] Inventor: Heinrich Bohnenkamp, Neuss, Fed. Rep. of Germany

[73] Assignee: SMS Schloemann-Siemag Aktiengesellschaft, Dusseldorf, Fed. Rep. of Germany

[21] Appl. No.: 348,628

[22] Filed: May 8, 1989

[30] Foreign Application Priority Data

May 6, 1988 [DE] Fed. Rep. of Germany ..... 3815454

[51] Int. Cl.[5] ..... B21B 31/18; B21B 29/00

[52] U.S. Cl. ..... 72/247; 72/245

[58] Field of Search ..... 72/247, 245, 241, 239, 72/238

[56] References Cited

U.S. PATENT DOCUMENTS 4,543,810 10/1985 Stoy et al. ..... 72/245

FOREIGN PATENT DOCUMENTS 256410 2/1988 European Pat. Off. ..... 72/247

2027350 12/1971 Fed. Rep. of Germany ..... 72/238

3627690 2/1988 Fed. Rep. of Germany .

191507 10/1984 Japan ..... 72/238

*Primary Examiner*—Daniel C. Crane

*Attorney, Agent, or Firm*—Herbert Dubno

[57] ABSTRACT

The bending and balancing mechanism for axially shiftable rolls of a roll stand, especially the working rolls of a four-high roll stand, comprises a guiding block rigidly mounted in a stand window of each roll stand and roll supporting members supported horizontally slidable adjacent both ends of the rolls on an upper and/or lower lifting housing guided vertically on the guiding block. The roll bending forces are transmittable from bending cylinders to the roll supporting members and at least one bending cylinder, advantageously hydraulic cylinder, engages on the upper and lower lifting housing, this bending cylinder being supported on a stationary guiding block. Because of this latter structure the bending and balancing forces are better transmitted to the working or other rolls.

3 Claims, 1 Drawing Sheet

BENDING AND BALANCING MECHANISM FOR THE AXIALLY SHIFTABLE ROLLS OF A ROLL STAND

CROSS REFERENCE TO RELATED APPLICATIONS AND PATENTS

This application is related to the following prior applications and patents: U.S. Pat. No. 4,548,064 issued on Oct. 22, 1985 and U.S. Pat. No. 4,751,837 issued on June 21, 1988 and application Ser. No. 011,979 filed on Feb. 6, 1987 and application Ser. No. 209,277 filed on June 17, 1988 (now U.S. Pat. No. 4,848,128 issued July 18, 1989).

FIELD OF THE INVENTION

My present invention relates to a bending and balancing mechanism for the axially shiftable rolls of a roll stand and, more particularly, to a bending and balancing mechanism for the axially shiftable working rolls of a four-high roll stand.

BACKGROUND OF THE INVENTION

A bending and balancing mechanism for the axially shiftable rolls of a roll stand, especially for the working rolls of a four-high rolling mill, is known from German open application DE OS No. 36 27 690 in which a guiding block is mounted fixed in position on each side in a stand window of the roll stand and a plurality of roll supporting members are supported so as to be horizontally slidable adjacent each end of the rolls on an upper and/or lower lifting housing guided vertically in the guiding block and roll bending forces are transmitted from the bending cylinders to the roll supporting members.

In the bending and balancing mechanism of the type described in German Open Patent Application No. 36 27 690, two bending cylinders act on each of the lifting housings guiding the horizontally slidable roll supporting members, which are mounted so that the upper lifting housing receives the cylinder piston, while the piston rod or shaft is connected to the lower lifting housing. For working roll bending, the cylinder piston located in the upper lifting housing is acted on exteriorly, whereby pressing forces caused by the piston rods are applied to the lower lifting housing. As a result, forces directed upwardly from the upper lifting housing are transmitted to the sliding surfaces of the structural members and downwardly acting forces are transmitted by the lower lifting housing on the sliding surfaces of the lower structural member.

The design with the lifting housing and bending cylinder facilitates replacement and maintenance, whereby shorter idle times for the roll stand are attainable. That is also true when the hydraulic mechanism for axial working roll shifting is combined with the lifting housing.

OBJECT OF THE INVENTION

It is an object of my present invention to improve the known bending and balancing mechanism to allow application of bending forces separately on each individual lifting housing so that the roll bending can be improved and the balancing of the rolls with the structural members can be adjusted more accurately to avoid uncontrollable forces and moments on the heavily loaded roll bearings.

SUMMARY OF THE INVENTION

This object and others which will become more readily apparent hereinafter is attained in accordance with my invention in a bending and balancing mechanism for a plurality of axially shiftable rolls of a roll stand, especially for the working rolls of a four-high rolling mill.

According to my invention at least one bending cylinder, which is supported on a guiding block, engages on one of the upper and lower lifting housings. As a consequence the bending forces advantageously act on each individual lifting housing and thus separately on the structural members of the upper and lower working rolls. Reactive effects from the bending forces as a result of the reaction forces on the upper and lower working rolls can be avoided, since the reaction forces are taken up by the roll stand. Thus, the bending forces can be applied more accurately and effectively to each individual roll. Because these two bending cylinders act separately on each lifting housing, the balancing system acting as a hydraulic balance is effectively adjustable so that uncontrollable forces and moments on the highly loaded roll bearings can be avoided.

The guiding block can have a crosspiece centrally cantilevered into the stand window of the roll stand, on whose upper and lower crosspiece surface the bending cylinder is supported. These features permit a good guiding during the perpendicular motion of the lifting housings. Because of the satisfactory guiding of the lifting housing an outstanding seal of the housing against cinders, dust or otherwise damaging influences originating from rolling mill operation is guaranteed.

Advantageously the bending cylinder is located at least partially in the lifting housing, a cylinder piston being guided in a suitable passage of the lifting housing and a piston shaft being attached with the crosspiece of the guiding block. This feature provides a simple, strong and reliable structure for the bending mechanism. The lifting housing can be quickly replaced as a structural unit with the integrated bending cylinder. Because of its maintenance-friendly construction, idle times are reduced.

The lifting housings can have an upper shoulder for support of the roll supporting members, in which a sliding piece for the horizontal bearing surface of the roll supporting member is provided so that the center of the bending cylinder and the center of the bearing surface are located in the same vertical plane. Additional friction forces are avoided on the bearing surface, since no moment can arise between the bearing surface of the working roll supporting member and the bending cylinder.

In the bending and balancing mechanism of the invention, the guiding block can have a central projection fitting the vertical extent of the lifting housing, which engages centrally in the lifting housing in a suitably formed recess and at least partially a plurality of sliding surfaces for the guiding block and the roll supporting member are located on vertical contacting surfaces of the lifting housing. Hence, each lifting housing is guided centrally in the guiding block over the largest possible length, so that the friction forces acting to oppose the motion are limited to the structurally required minimum values.

In another advantageous feature of my invention a mechanism for axially moving the rolls, especially the working rolls, can be combined with the lifting housing.

This mechanism is connected with the roll supporting member with the help of at least one cam element. Hence relative motion between the roll supporting members and the motion system on perpendicular motion of the working rolls can be avoided. Thus no tilting moment can act on the rolls which might impair their bearing strengths.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
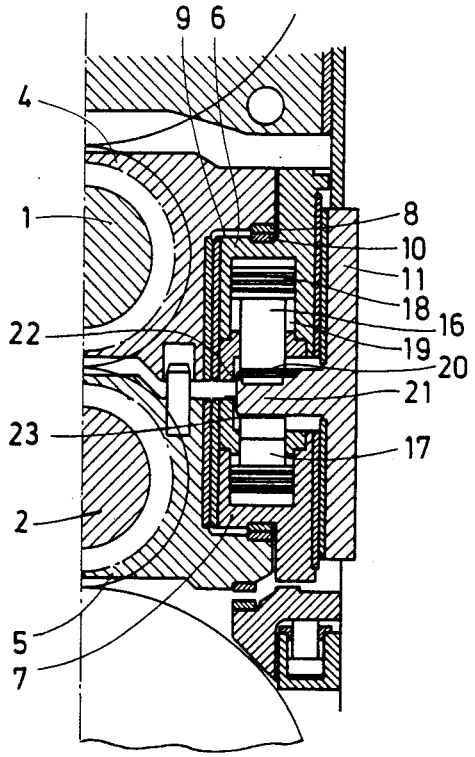
FIG. 1 is a partial cutaway cross sectional view of the upper and lower working roll supporting members with lifting housings and bending cylinders in a four-high mill stand.

As can be seen from FIG. 1, the working rolls 1, 2 of a four-high mill are mounted on supporting members 4, 5 in the roll stand 3 (FIG. 2) of the rolling mill. The upper working roll 1 is supported against an upper roll and the lower working roll 2 is supported on a lower member.

Each roll supporting member 4, 5 is guided so as to be horizontally slidable on a shoulder 9 of a lifting housing 6, 7 on each of its ends. For this purpose the roll supporting member 4 or 5 is provided with a bearing surface 8 which slides on a slide piece 10 mounted in the supporting shoulder 9 of the lifting housing.

The two parts of the lifting housings 6, 7 are guided so as to be vertically slidable in a common guiding block 11. The guiding block 11 is rigidly attached to the roll stand 3. The guiding block 11 has a projection 12 fitting approximately centrally into recesses 13 to extending over extents of the lifting housing 6, 7, the recesses 13 being formed in a central longitudinal portion of the lifting housing.

Figure 2:
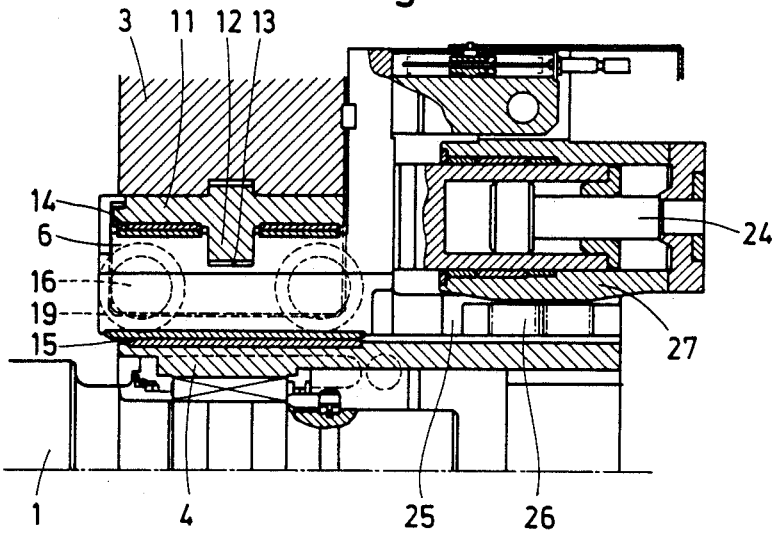
FIG. 2 is a partial cross sectional view of a roll supporting member with a mechanism for axially sliding a working roll according to my invention.

The vertical contacting surfaces of the lifting housings 6, 7 on the guiding block 11 and on the roll supporting member 4, 5 are provided with sliding surfaces 14, 15 (FIG. 2.).

The bending and balancing cylinders 16, 17 are mounted in the lifting housings 6, 7 in such a way that the cylinder piston 18 is guided in a suitable passage 19 in the lifting housings and the piston shaft 20 is supported on a crosspiece 21 of the guiding block 11 cantilevered (i.e. projecting horizontally) into the stand window.

The roll stand 3 is not shown in great detail in FIG. 2 which shows the guiding block 11 is rigidly attached to the stand 3. The central projection 12 of the guiding block 11 is seen to be in the appropriate recess 13 of the upper lifting housing 6. The passages 19 shown with dashed lines which receive the cylinder pistons 18 of the bending cylinder 16 are seen to be in the lifting housings.

The vertical contacting surfaces of the lifting housings on the guiding block 11 and on the roll supporting member 4 contain the sliding surfaces 14, 15.

A mechanism 24 for axially moving the working roll 1 is connected to the lifting housing 6, which is connected to the roll supporting member 4 with the help of a cam element 25. This cam element comprises two pinions 26, which are mounted on one side of the stand on a thrusting housing 27 of the roll-moving mechanism and on the other side with a rack which is not shown in detail. This rack is mounted on the roll supporting member 4.

For working roll bending and balancing of the rolls the bending cylinders 16, 17 mounted on the lifting housings 6, 7 are acted on with a hydraulic medium on the piston exterior. Each bending cylinder is supported on the upper crosspiece surface 22 and/or the lower crosspiece surface 23 of the stand-fixed guiding block 11.

The pressing forces produced are transmitted from the bending cylinder to the lifting housings 6, 7 and from there to the roll supporting members 4, 5. As a result, each lifting housing has its own bending cylinders, which support themselves separately on the guiding block 11, namely on each lifting housing, and thus provides on each end of the roll supporting members exactly predetermined bending forces which balance or compensate for bending of the roll supporting members so that the predetermined bending forces guarantee the desired stressing or bending of the working rolls on the one hand and avoid damaging moments on the roll bearings on the other hand.

I claim:

1. A roll bending and balancing mechanism for a rolling mill, comprising:

an upper working roll and a lower working roll having respective ends;

a rolling mill stand formed with respective windows receiving said ends of said working rolls;

a respective upper roll-supporting member received in each of said windows and rotatably supporting a respective end of said upper rolls, and a lower roll-supporting member rotatably receiving a respective end of said lower roll and received in a respective one of said windows, said roll-supporting members and the respective rolls being axially shiftable horizontally relative to said stand;

an upper lifting housing and a lower lifting housing respectively engaging an upper one of said roll-supporting members and a lower one of said roll-supporting members in each of said windows, each of said lifting housings being formed with a horizontal guide surface slidably engaging a horizontal guide surface of the respective roll-supporting member along each side of said rolls, said horizontal guide surfaces arranged to permit axial movement of said upper and lower working rolls and their respective upper and lower one of said roll-supporting members being slidable relative to said respective upper and lower lifting housings on said horizontal guide surfaces;

a respective guiding block in each of said windows fixed to said stand and provided with means for vertically guiding the respective upper and lower lifting housing relative to said stand, said blocks each being formed with a respective cross piece projecting from said vertical guide means inwardly toward the interior of the respective window between the respective lifting housings; and at least one upper piston received in a respective cylinder at each side of said rolls in each upper lifting housing and having a piston shaft connected to the respective cross piece and at least one lower piston guided in a respective cylinder formed in each of said lower lifting housings on each side of said rolls in each of said windows and engaging the respective cross piece whereby said pistons shift said housings vertically relative to said cross pieces and respective blocks in the respective windows, axes of said pistons and centers of said horizontal guide surfaces on each side of said rolls lying in a common vertical plane.

2. The roll bending and balancing mechanism defined in claim 1 wherein each of said guiding blocks has a central projection extending vertically over the vertical extend of the respective lifting housings and laterally engaged in respective recesses formed in the respective lifting housings, so as to form respective vertical contact surfaces within interfitting central projections and recesses, said respective vertical contact surfaces of said lifting housings and the respective guiding block being formed as sliding surfaces along which said housings can shift relative to said guiding blocks.

3. The roll bending and balancing mechanism defined in claim 1 wherein each of said lifting housings on each side of said working rolls is provided with two of said cylinders and respective pistons in spaced-apart relationship along a direction of axial shiftability of said roll and braced against the respective cross piece.

* * * * *